US011518009B2

(12) United States Patent
Doroslovac et al.

(10) Patent No.: US 11,518,009 B2
(45) Date of Patent: Dec. 6, 2022

(54) ANTI-SLIP HEX ALLEN TOOL

(71) Applicants: Ruth Doroslovac, Thonotosassa, FL (US); Robert Doroslovac, Massillon, OH (US); George Doroslovac, Thonotosassa, FL (US)

(72) Inventors: Ruth Doroslovac, Thonotosassa, FL (US); Robert Doroslovac, Massillon, OH (US); George Doroslovac, Thonotosassa, FL (US)

(73) Assignee: BGD Unlimited, LLC, Thonotosassa, FL (US)

( * ) Notice: Subject to any disclaimer, the term of this patent is extended or adjusted under 35 U.S.C. 154(b) by 246 days.

(21) Appl. No.: 17/078,280

(22) Filed: Oct. 23, 2020

(65) Prior Publication Data

US 2022/0126426 A1 Apr. 28, 2022

(51) Int. Cl.

| | |
|---|---|
| ***B25B 23/10*** | (2006.01) |
| ***B25B 15/00*** | (2006.01) |
| ***B25B 23/00*** | (2006.01) |

(52) U.S. Cl.

CPC ..... *B25B 23/108* (2013.01); *B25B 15/008* (2013.01); *B25B 23/0035* (2013.01)

(58) Field of Classification Search

CPC .. B25B 15/008; B25B 23/108; B25B 23/0035
See application file for complete search history.

(56) References Cited

U.S. PATENT DOCUMENTS

| | | | | |
|---|---|---|---|---|
| 2,518,886 | A * | 8/1950 | Halvorsen | B25B 15/008 81/436 |
| 3,733,937 | A * | 5/1973 | Mezey | B25B 15/008 81/448 |
| 3,894,450 | A * | 7/1975 | Hill | B25B 23/106 81/460 |
| 4,105,056 | A | 8/1978 | Arnn | |
| 6,152,000 | A | 11/2000 | Mowins | |
| 8,302,255 | B2 | 11/2012 | Lin | |
| 8,640,575 | B2 | 2/2014 | Huang | |
| 2004/0031360 | A1 * | 2/2004 | Her | B25B 15/008 81/436 |

* cited by examiner

*Primary Examiner* — David B. Thomas
(74) *Attorney, Agent, or Firm* — Harpman & Harpman

(57) ABSTRACT

A hex headed bit and socket for enhanced non-slip application of torque force having a hex head with contoured fastener engagement surface channel at the center of the respective alternating flat tool engagement sides. The contoured channels are tapered both transversely and longitudinally and extend in angular inclination across hex head bit flat side. The defined primary channel lateral edges correspondingly embed themselves during rotational engagement within the so engaged fastener pulling the hex head bit into the engaged fastener imparting enhanced translateral points of tool engagement.

5 Claims, 6 Drawing Sheets

ANTI-SLIP HEX ALLEN TOOL

BACKGROUND OF THE INVENTION

1. Technical Field

This invention is directed to hex headed bits for the use with hex headed fasteners as an anti-slip multi-directional drive bit for driving and removing of hex headed fasteners. Such tool bits known and used in the art are defines as six sided flat surfaces for engagement and correspondingly configured receptacles for rotation to tighten and loosen as needed. Such fastener bolt designs may be compromised during use due to metal fatigue, rust and general abuse imparted by improper tool use thus making them difficult to engage by a typical hex headed tool.

2. Description of Prior Art

Prior art hex wrench and bit tool configurations can be seen in the following U.S. Pat. Nos. 4,105,056, 6,152,000, 8,302,255 and 8,640,575.

In U.S. Pat. No. 4,105,056, a non-slip screwdriver can be seen having a grooved foot portion from the driver blade with oppositely disposed parallel engagement grooves there across defining recessed surfaces.

U.S. Pat. No. 6,152,000 is directed to a driver bit and driver tool having a plurality of projections formed on at least one surface of the fastener engagement shank portion to enhance the tool to fastener registration engagement.

U.S. Pat. No. 8,302,255 illustrates a hexagonal wrench head with longitudinal groove adjacent the respective side surfaces edge intersections there along.

U.S. Pat. No. 8,640,575 discloses a ball end hex wrench wherein a groove is formed within the contoured multiple sides longitudinally.

SUMMARY OF THE INVENTION

The present invention provides a driver bit for engaging and maintaining efficient contact within a fastener to transfer rotational force from the drive bit to the fastener while maintaining proper engagement therewith. Contoured tapered engagement surface channel cuts within alternating flat hex bit surfaces define directional engagement edges that dig into the registering fastener surfaces pulling the driver bit down within the fastener maintaining fastener engagement during rotational torque input.

DETAILED DESCRIPTION OF THE INVENTION

Referring to FIGS. 1-7 of the drawings, an anti-slip socket box end hex bit 10 of the invention can be seen having a cylindrical screw bit body 11 with a hex shank fastener engagement socket portion 12 extending therefrom.

Figure 1:
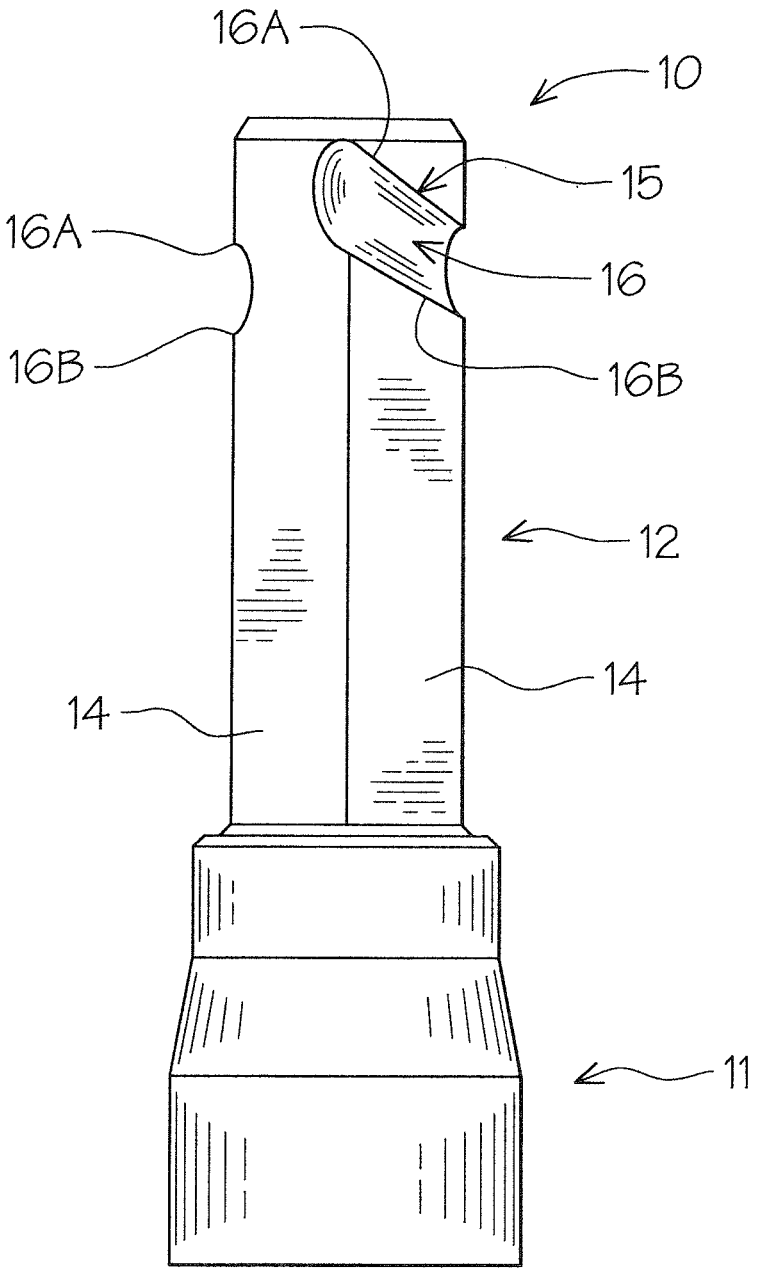
FIG. 1 is an enlarged front elevational view of the anti-slip hex socket bit of the invention.
Figure 2:
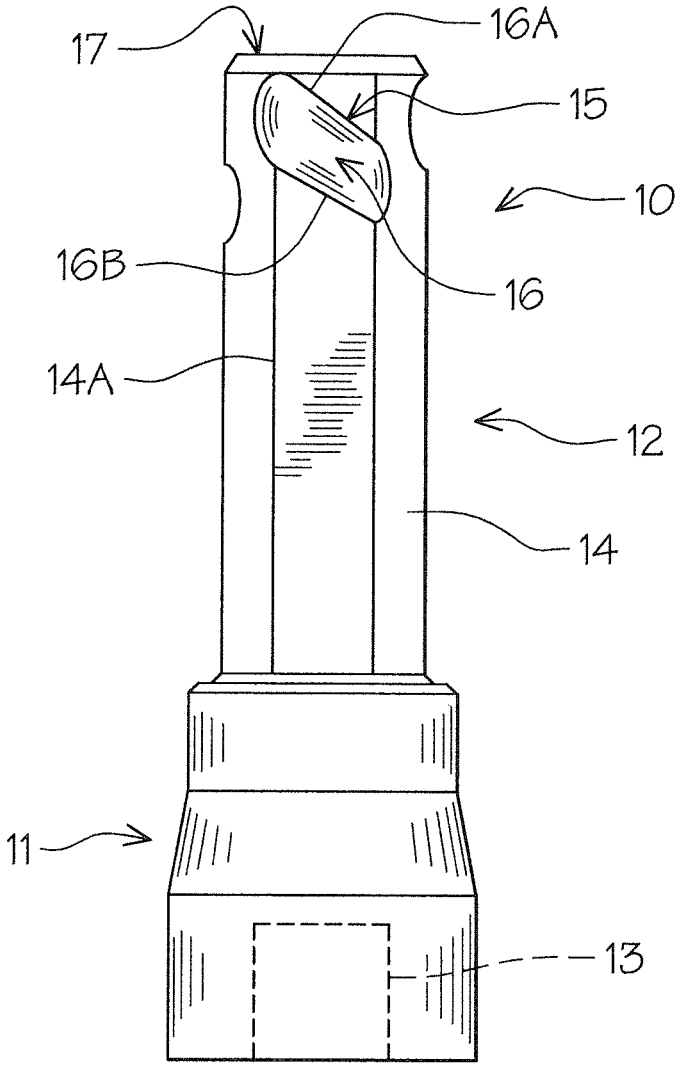
FIG. 2 is an enlarged rear elevational view thereof.
Figure 3:
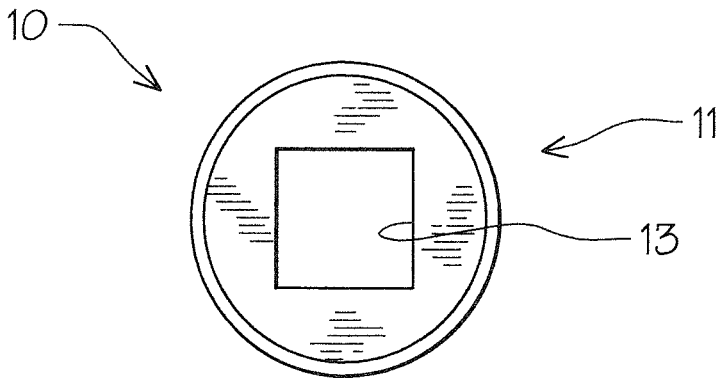
FIG. 3 is an enlarged bottom plan view thereof.
Figure 4:
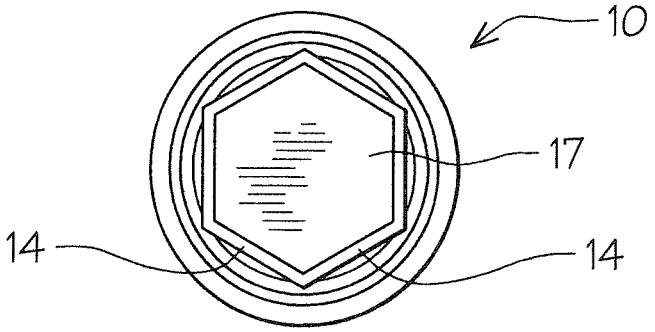
FIG. 4 is an enlarged top plan view thereof.
Figure 5:
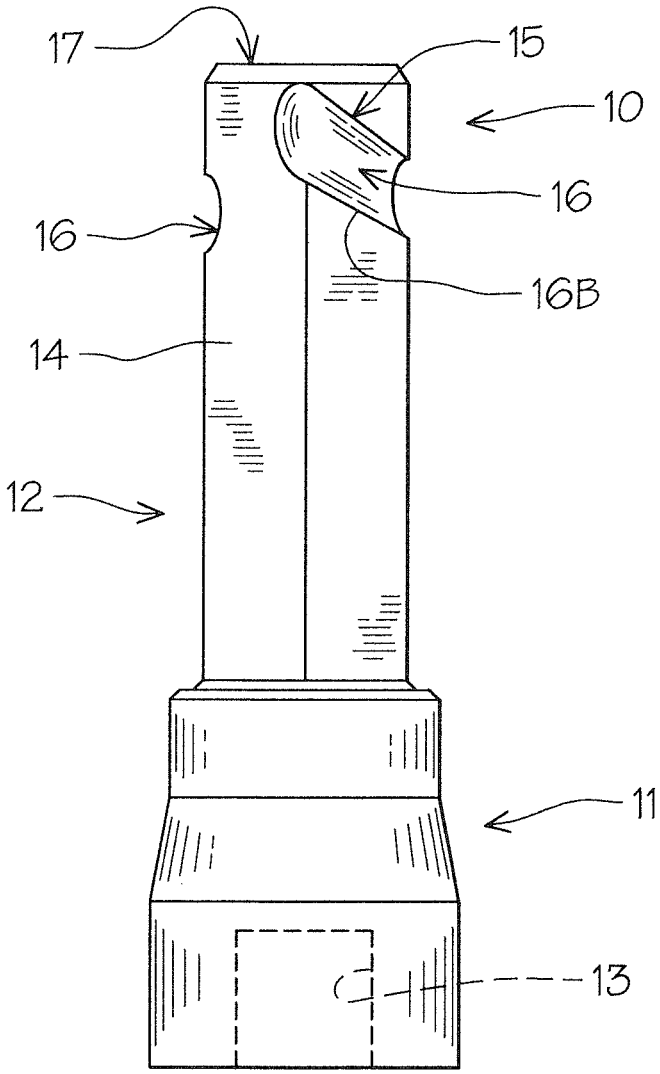
FIG. 5 is an enlarged side elevational view of the anti-slip hex socket bit of the invention.
Figure 6:
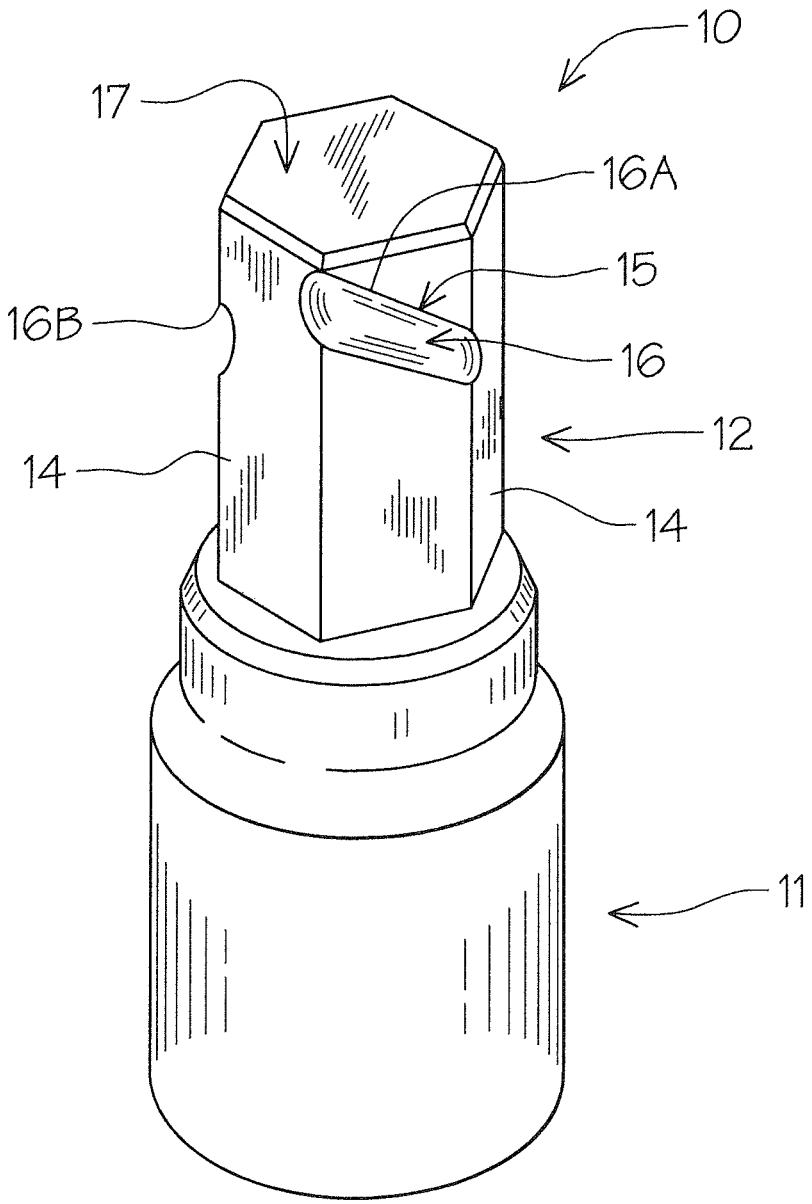
FIG. 6 is an enlarged top perspective view thereof.
Figure 7:
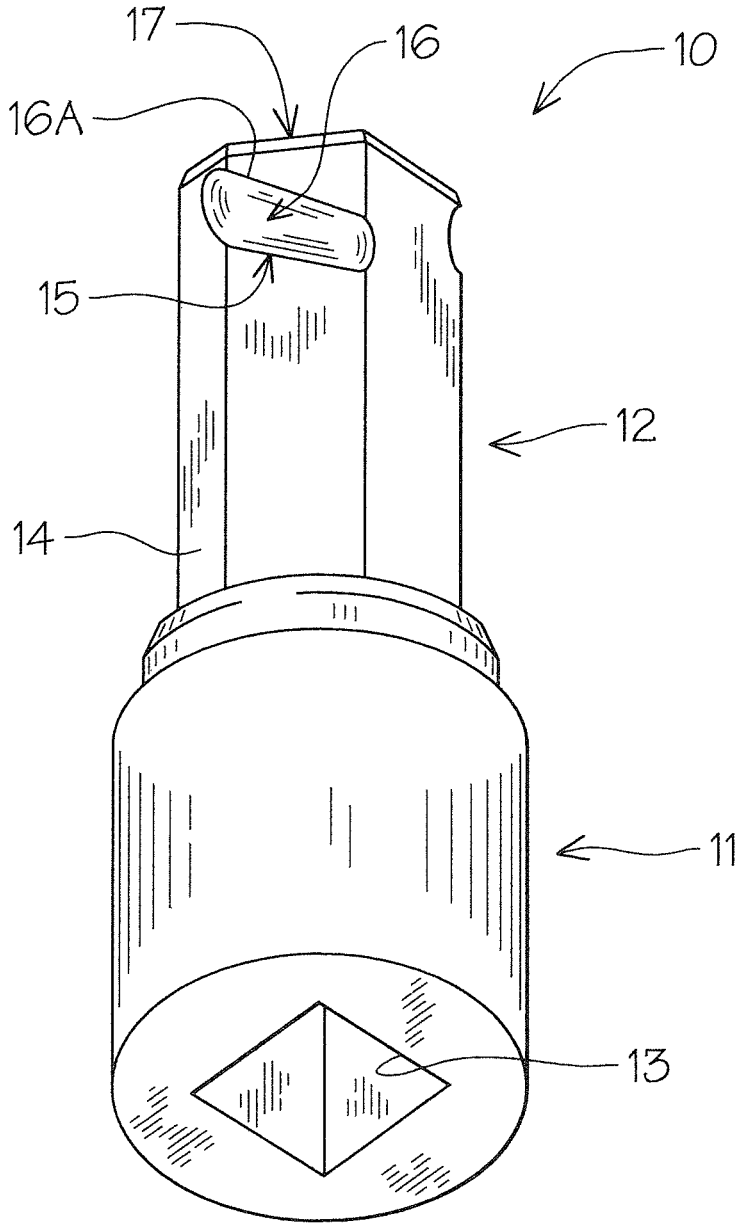
FIG. 7 is an enlarged bottom perspective view thereof.
Figure 8:
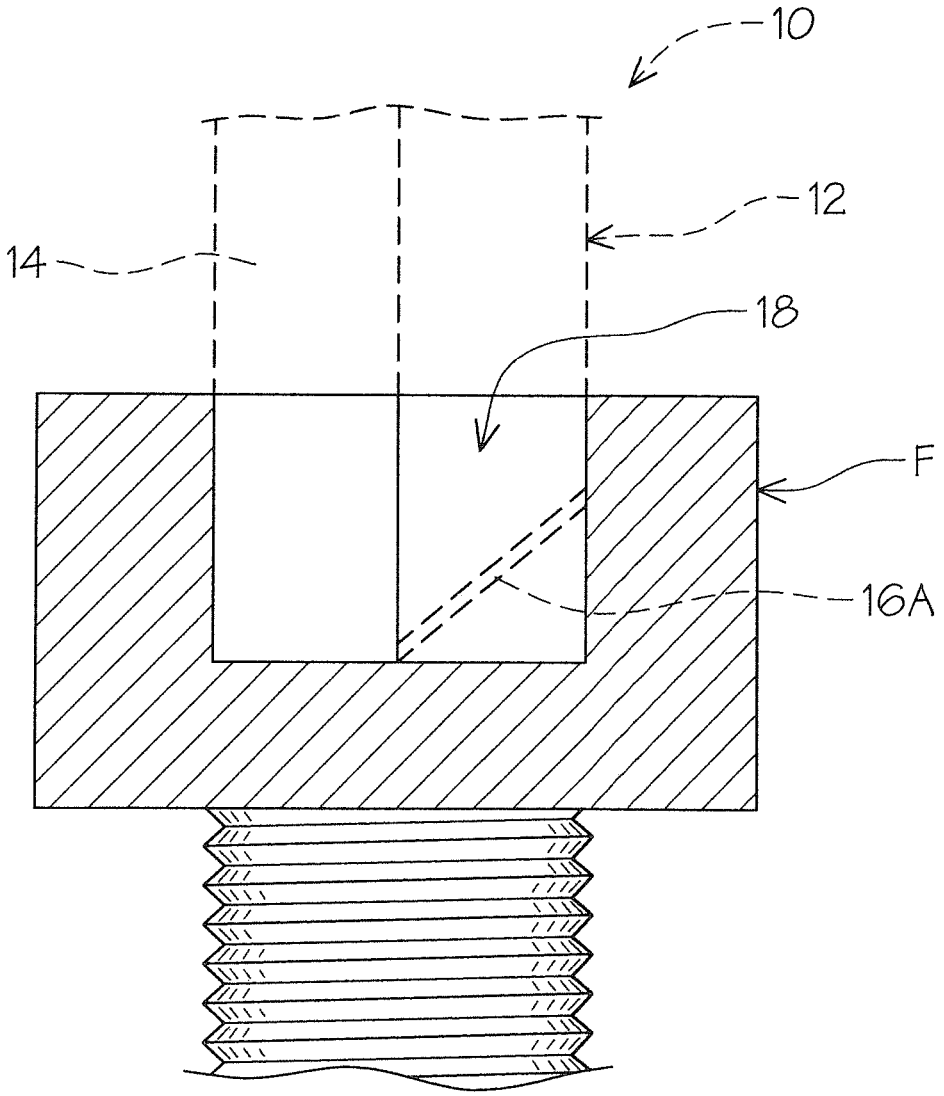
FIG. 8 is an enlarged graphic representation of the present invention engaged in a fastener illustrating points of contact in solid and broken lines.

A driver engagement bore 13, best seen in FIG. 8 of the drawings, extends into the cylinder screw bit body 11 and is shaped to receive a socket fitting member of a socket driver wrench, not shown, as will be evident to those skilled and well known in the art.

The hex engaged shank portion 12 has a plurality of elongated flat fastener engagement surfaces 14 of equal transverse and longitudinal dimension there about so as to define a hex tool bit configuration known within the art. The fastener engagement socket is therefore hexagonal with a plurality of flat engagement surfaces spaced radially about the longitudinal axis of the shank portion 12.

Some of the flat hex engagement surfaces 14 have a contoured C-shaped fastener engagement channel cut 15 therein. Each of the contoured engagement channel cuts 15 extend angularly across its respective hexagonal surface 14 having a contoured transverse tapered interior surface 16. The engagement channel cut 15 is also tapered longitudinally between respective opposing intersecting flat engagement surfaces 14A and 14B, best seen in FIG. 2 of the drawings.

The contoured transverse tapered interior surface 16 of the engagement channel cut 16 is of a modified C-shape defining a pair of upstanding elongated fastener engagement lateral edges 16A and 16B extending in angular spaced relation from the shank 12 fastener insert end 17. The so-configured engagement channel cut 15 being selectively cut in alternate engagement surfaces 14 about the hex bit 10 indirect contact thereby providing multiple points of enhanced non-slip fastener engagement as seen in FIG. 8 of the drawings graphically. This channel engagement orientation will thereby accommodate both undamaged and damaged fasteners, not shown, as will be discussed in greater detail hereinafter.

The contoured tapered interior surface 16 of each engagement channel cut 15 thereby defines both a primary fastener lateral engagement edge 16A and the secondary lateral edge 16B in spaced orientation thereby provides for the displacement of fastener material as needed during rotational engagement assuring a secure and active multiple point engagement regardless of the fastener's condition within the fastener's receiving area 18. The contoured tapered interior modified C-shape channel cut 16 is tapered transversely from the elongated primary fastener engagement lateral edge 16A upwardly to the so defined secondary fastener engagement lateral edge 16B as seen best in FIG. 7 of the drawings It will be seen that the hereinbefore described alternating placement of the unique contoured engagement channel cut 15 in three of the fastener engagement surfaces 14 thereby having a snug contact with the corresponding undamaged interior surfaces of the fastener's receiving area 18 and three engagement surfaces with the contoured center engagement channel cut 15 which work in concert to achieve an enhanced grip within the engagement fastener regardless of the relative fastener's condition as hereinbefore described.

During operation, the angular orientation of the contoured engagement channel cut 15's lateral edges 16A will engage within the fastener F and pull the hex bit 10 increasingly into the fastener's receiving area 18 thus maintaining the enhanced trilateral contact so achieved. It will be evident that the hex bit 10 engagement channel cut 15 will protrude inwardly towards the fastener at a corresponding scale percentage based on the size of the tool. It will also be apparent that the multiple contoured engagement channel cut 15's lateral edges 16A and 16B will allow during use "pivoting" of the hex bit tool 10 when the fastener engagement surfaces are compromised thus, as noted, forcing the hex bit tool to embed itself in the fastener to form a deeper and thereby better grip engagement with the compromised fastener.

This combination of flat engagement surfaces 14 with multiple selective positioning engagement channel cuts 15 will thereby provide multiple points of enhanced focus engagement regardless of fastener's condition in either rotational direction superior grip and hold currently unavailable within the art.

It will thus be seen that a new and useful anti-slip socket wrench hex head bit configuration has been illustrated and described and it will be apparent to those skilled in the art that various changes and modifications may be made therein without departing from the spirit of the invention. Therefore,

We claim:

1. An omni-directional multi-grip socket bit for hexagonal fasteners comprising, a screw bit body having a fastener engagement free end portion and a tool engagement end portion, a plurality of flat fastener engagement surfaces about said fastener engagement free end portion defining a hexagonal engagement shank, at least one contoured fastener engagement channel cut transversely in at least one of said flat fastener engagement surfaces defining a first and second lateral fastener engagement edges, a contoured transverse tapered interior surface extending between said channel cut's lateral edges, said fastener engagement channel cut in angular orientation to the longitudinal axis of said tool engagement portion, said first lateral fastener engagement edge defining an interior fastener engagement surface in spaced relation to said second lateral edge.

2. The omni-directional multi-grip socket bit for hexagonal fasteners set forth in claim 1 wherein said elongated fastener engagement channels first and second lateral fastener engagement edges extend in tapered parallel relation to one another between longitudinal intersections of said respective adjacent flat fastener engagement surfaces.

3. The omni-directional multi-grip socket bit for hexagonal fasteners set forth in claim 1 wherein said respective engagement channel cut is in axially inwardly spaced relation to said multi-grip socket tool engagement free end portion.

4. The omni-directional multi-grip socket bit for hexagonal fasteners set forth in claim 1 wherein said fastener engagement channel cut contoured transverse tapered interior surface defines a sloping transverse C-shaped configuration.

5. The omni-directional multi-grip socket bit for hexagonal fasteners set forth in claim 4 wherein said fastener engagement contoured C-shape configured interior transverse taper extends from the primary elongated fastener engagement lateral edge upwardly to the secondary engagement lateral edge.

* * * * *